US007298983B2

(12) United States Patent
Silvestri et al.

(10) Patent No.: US 7,298,983 B2
(45) Date of Patent: Nov. 20, 2007

(54) METHOD FOR DETECTING LATERAL SURFACE CHARGE MIGRATION THROUGH DOUBLE EXPOSURE AVERAGING

(75) Inventors: Markus Rudolf Silvestri, Fairport, NY (US); Surendar Jeyadev, Rochester, NY (US); Satchidanand Mishra, Webster, NY (US); M. John Hinckel, Rochester, NY (US); Edward Domm, Hilton, NY (US); James M. Markovics, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 597 days.

(21) Appl. No.: 11/005,980

(22) Filed: Dec. 7, 2004

(65) Prior Publication Data

US 2006/0120556 A1 Jun. 8, 2006

(51) Int. Cl.
*G03G 15/00* (2006.01)

(52) U.S. Cl. ..... 399/48; 399/159

(58) Field of Classification Search ..... 399/26, 399/31, 48, 127, 159; 324/72, 72.5, 452, 324/455

See application file for complete search history.

(56) References Cited

U.S. PATENT DOCUMENTS

| | | | | |
|---|---|---|---|---|
| 5,163,075 | A * | 11/1992 | Lubinsky et al. | 378/28 |
| 6,124,072 | A * | 9/2000 | Arai et al. | 430/128 |
| 6,223,006 | B1 * | 4/2001 | Scheuer et al. | 399/48 |
| 6,461,780 | B2 * | 10/2002 | Itami et al. | 430/58.15 |
| 6,516,161 | B2 * | 2/2003 | Asai | 399/48 |
| 6,647,219 | B2 * | 11/2003 | Buettner | 399/48 |

FOREIGN PATENT DOCUMENTS

| | | | |
|---|---|---|---|
| JP | 05323741 | A * | 12/1993 |
| JP | 2004037680 | A * | 2/2004 |

* cited by examiner

*Primary Examiner*—Robert Beatty
(74) *Attorney, Agent, or Firm*—Eugene O. Palazzo; Fay Sharpe LLP

(57) ABSTRACT

The amount of lateral charge migration (LCM) on a photoreceptor is quantified by measuring the average potential of a latent image formed on the photoreceptor surface. The surface is first uniformly charged, then exposed a first time to an image. After a waiting period during which LCM may occur, the surface is exposed a second time to the image. After another waiting period, the average potential is measured. The amount of LCM may be quantified by varying the waiting periods.

5 Claims, 7 Drawing Sheets

METHOD FOR DETECTING LATERAL SURFACE CHARGE MIGRATION THROUGH DOUBLE EXPOSURE AVERAGING

BACKGROUND

Illustrated herein is a method of measuring the lateral charge migration by measuring the average potential of a latent image formed on a photoreceptor surface. It finds particular application in conjunction with detecting lateral charge migration, and will be described with particular reference thereto. However, it is to be appreciated that the present exemplary embodiment is also amenable to other like applications.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multi-layered photoreceptors that comprise a substrate, a conductive layer, an optional hole blocking layer, an optional adhesive layer, a charge generating layer, and a charge transport layer, an optional overcoating layer and, in some belt embodiments, an anti-curl backing layer. Materials and methods for producing such photoreceptors are well-known in the art.

The resolution of the final print depends heavily on the location of the electrostatic charge upon the imaging surface of the photoconductive insulating layer. Lateral charge migration (LCM), i.e. the movement of charges on or near the surface of an almost insulating photoconductor surface, has the effect of smoothing out the spatial variations in the surface charge density profile of the latent image. It can be caused by a number of different substances or events (i.e., by ionic contaminants from the environment, by naturally occurring charging device effluents, etc.), which cause the charges to move. LCM can occur locally or over the entire photoconductor surface. As a result, some of the fine features present in the input image may not be present in the final print. This is usually referred to as wipeout or deletion.

Because deletion is undesirable, it is necessary to distinguish acceptable photoconductors (i.e. with no or low LCM) from unacceptable photoconductors (i.e. with high LCM). Often it is not possible, nor desirable, to carry out print tests for deletion; hence, another method is needed. A direct measurement of the latent image profile requires a probe that can detect voltages or fields at the photoconductor surface with a resolution on the scale of tens of microns. Current probes that measure absolute values, i.e., electrostatic voltmeters (ESV), have only a resolution on the order of millimeters. Thus, a resolution improvement of more than an order of magnitude is required for a direct measurement.

Indirect measurements of the LCM are possible. Surface conductivity measurements are commonly used to quantify LCM. However there are problems associated with conventional surface conductivity measurements: 1) they are steady state measurements, 2) the photo-conductor is near insulating and hence, there is the issue of contacts, and 3) in the xerographic process the surface is charged with ions but no ions are usually involved in the traditional steady state surface conductivity measurements.

Furthermore, the only technique that has been used to identify LCM in dual-layer, negatively charged photoreceptors concerned the degree of positive charge acceptance. Photoreceptors with less positive charge acceptance were classified as devices with higher potential for LCM. However, the positive charge acceptance at best only correlates to LCM; there is a degree of error in the correlation. Thus, there is still a need for a better method of quantifying LCM.

BRIEF DESCRIPTION

Disclosed herein is a method to measure lateral charge migration (layer). The method measures lateral charge migration as a function of exposure-to-development time.

In this regard, the method measures the average potential of a latent image formed on the photoreceptor surface after it has been exposed at least two times to the same pattern. This method of measuring LCM has several advantages. It is conceptually simple and easy to implement. Using this method, LCM can be measured electrically rather than through printing images and manually looking for deletion effects. The spatial resolution of the measurement is not limited by the resolution of current electrostatic probes. LCM can be measured as a function of exposure-to-development time by varying the time between exposures. This method can also be incorporated into existing photographic machines for continuous use in quality control.

In a further embodiment, a method for measuring lateral charge migration upon the surface of a photoreceptor is provided. The method involves providing an area of a photoreceptor which is charged to a uniform value over the area. The area is then exposed at a first time to a pattern. After pausing for a first period of time, the area is exposed to a second time to the same pattern. After pausing for a second period of time, the average potential over the area is measured.

These and other aspects and/or objects of the disclosure are more particularly described below.

BRIEF DESCRIPTION OF THE DRAWINGS

The following is a brief description of the drawings, which are presented for the purposes of illustrating the development disclosed herein and not for the purposes of limiting the same.

DETAILED DESCRIPTION

LCM can be quantified by measuring the average potential of a latent image formed on the photoreceptor surface after it has been exposed at least two times to the same pattern. In certain embodiments, measurements are made twice within a short period of time for a given area of a photoreceptor. One measurement gives a reference value and the other measurement gives a test value. The difference between the two values quantifies the amount of LCM in that area of the photoreceptor. Alternatively, measurements can be made periodically for a given area of a photoreceptor and compared with previous measurements to track the change in LCM in that area of the photoreceptor over a long period of time for maintenance purposes.

Generally, the method involves exposing a photoreceptor surface at least twice to the same pattern and then measuring its average potential over a given area. The photoreceptor surface is first charged to a uniform value over its area. The photoreceptor is then exposed to the pattern, which creates a latent image on the photoreceptor surface. Then there is a pause for a period of time. During this period of time, factors such as dark decay and LCM occur which may change the distribution of charge on the photoreceptor surface. The photoreceptor is then exposed to the same pattern a second time. After this second exposure the average potential over this area is measured.

Figure 1A:
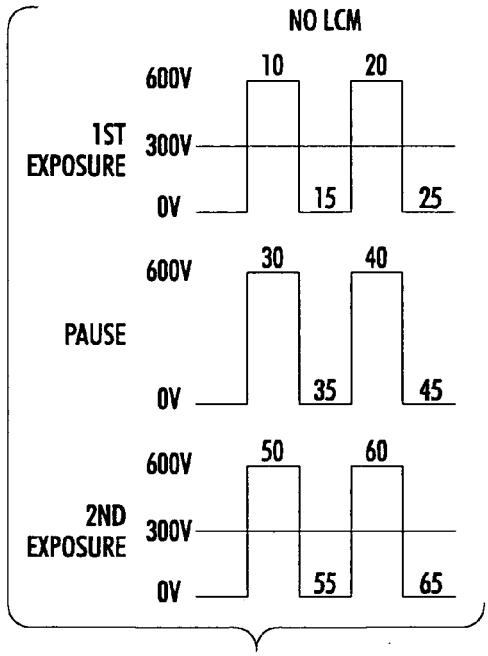
FIG. 1 is a series of diagrams illustrating the theory behind the method of measurement.
Figure 1B:
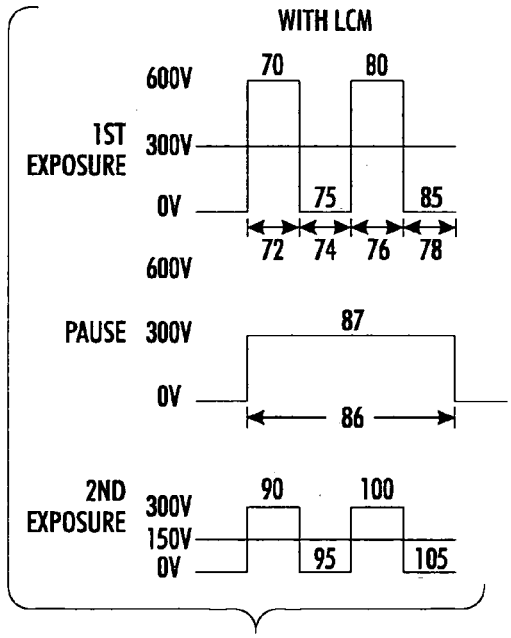

FIG. 1 (*a*) exemplifies the concept behind the use of double exposure averaging to detect LCM. In this example, it is assumed that a photoreceptor has a photo induced discharge curve (PIDC) that has a background potential of 0 volts (V) at an exposure of 10 ergs/cm$^2$. FIG. 1 (*a*) reflects the behavior of a photoreceptor with no LCM. There, a photoreceptor charged to 600V and subsequently exposed to a line pattern of 0 and 10 ergs/cm$^2$ forms a latent image as shown in the first row, labeled "First Exposure." The latent image reflects this line pattern. Peaks 10 and 20 retain their initial charge of 600V while troughs 15 and 25 have been discharged to 0V. A waiting time $t_1$ passes between the first and second exposures. During this time, factors such as dark decay and LCM may affect the distribution of the charges. In this example, there is no dark decay or LCM. In the second row, labeled "Pause," peaks 30 and 40 retain a charge of 600V (equal to the charges on peaks 10 and 20) and troughs 35 and 45 retain a value of 0V (equal to the charge of troughs 15 and 25). When this latent image is again exposed to the same line pattern, the new latent image shown in the third row, labeled "Second Exposure," is no different from the latent image formed after the first exposure because the peaks again receive no light and the trough has already been discharged to 0V. Peaks 50 and 60 retain a charge of 600V (equal to the charges on peaks 10 and 20) and troughs 55 and 65 retain a value of 0V (equal to the charge of troughs 15 and 25). Another waiting time $t_2$ passes and the average potential is then measured. After the second exposure, the average potential for the photoreceptor with no LCM is 300V.

FIG. 1 (*b*) reflects the behavior of a photoreceptor with LCM. Again, in the first row labeled "First Exposure," a photoreceptor charged to 600V and subsequently exposed to a line pattern of 0 and 10 ergs/cm$^2$ forms a latent image as shown. This latent image is identical to the latent image after the first exposure for the photoreceptor with no LCM. Peaks 70 and 80 retain their initial charge of 600V (equal to the charges on peaks 10 and 20) and troughs 75 and 85 have been discharged to 0V (equal to the charges of troughs 15 and 25). Peaks 70 and 80 and troughs 75 and 85 have all the same widths. A waiting time $t_1$ passes between the first and second exposures. However, LCM occurs during this time though dark decay is still assumed to be 0. Charge migrates from peaks 70 and 80 into troughs 75 and 85. In the second row labeled "Pause," the result of LCM is a peak 87 with a charge of 300V. When this latent image is again exposed to the same line pattern, the new latent image shown in the third row, labeled "Second Exposure," again reflects a line pattern with peaks and troughs. However, peaks 90 and 100 have a charge of only 300V. Troughs 95 and 105 have been discharged to a value of 0V. Another waiting time $t_2$ passes and the average potential is then measured. After the second exposure, the average potential for the photoreceptor with LCM is 150V. The difference in average potentials is attributed to LCM. For this particular example, the difference in average potentials due to LCM was: $\Delta V=300-150=150V$.

In the example of FIG. 1, a line pattern was used to be imaged onto the photoconductor. This should not be construed as limiting the method to using only line patterns. Any desired image may be used as the aerial image. For example, the aerial image may be composed of half tones. However, in preferred embodiments simple patterns are used for light exposure. For example, a rectangular line pattern or a sinusoidal line pattern may be used.

Figure 2:
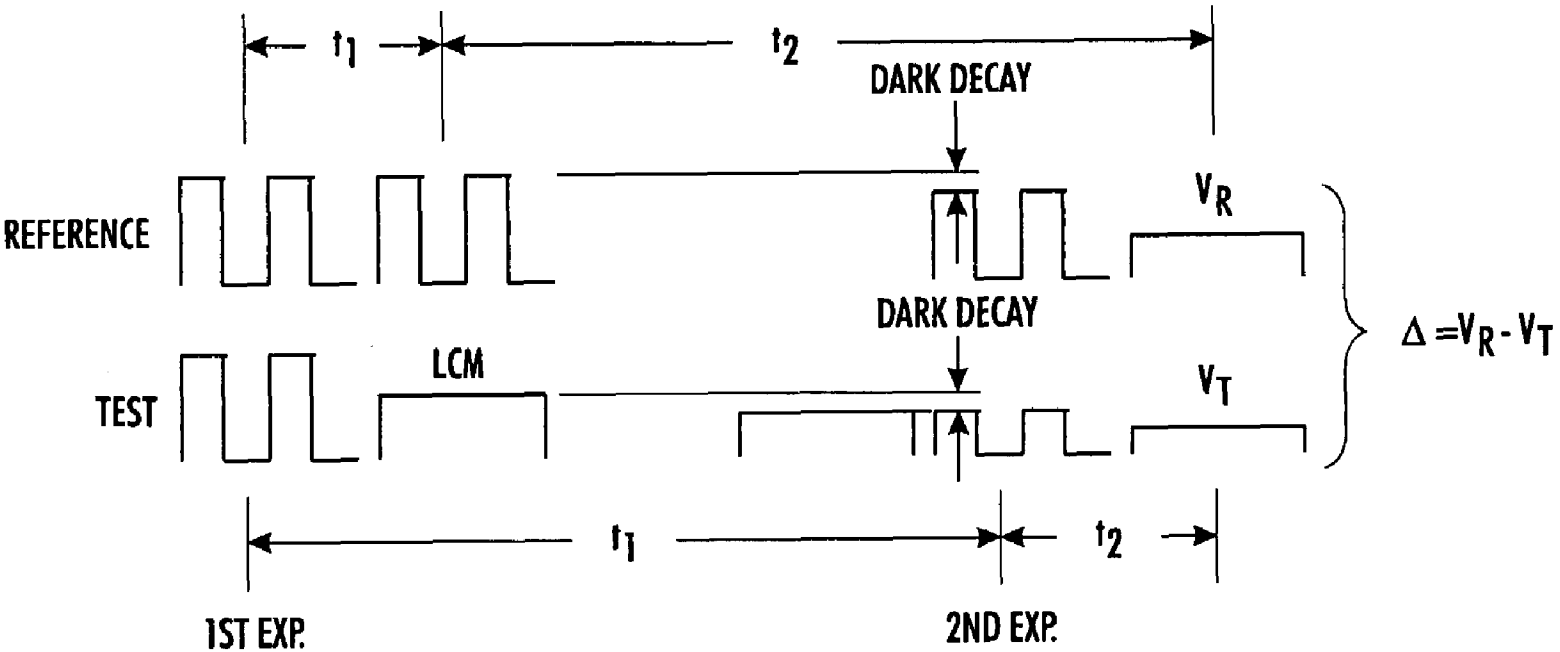
FIG. 2 is a diagram illustrating the use of the method of measurement to quantify the amount of lateral charge migration.

FIG. 2 exemplifies a method of using double exposure averaging to quantify the amount of LCM on a photoreceptor. In this embodiment, the same photoreceptor surface is measured twice, each time using different lengths of time for $t_1$ and $t_2$. Two measurements are shown, the "reference" measurement on the top row and the "test" measurement on the bottom row. For both measurements, the total waiting time $t_1+t_2$ is held constant. The reference measurement $V_R$ is obtained by setting $t_1$ to ~0 ms and $t_2$ to a large value. The test measurement $V_T$ is obtained by setting $t_1$ to a large value and $t_2$ to a smaller value. In this way, lower average potentials due to factors such as dark decay are minimized. The difference between the measurements $\Delta V=V_R-V_T$ quantifies the amount of LCM for the measured area of the photoreceptor. LCM can also be measured as a function of exposure-to-development time by varying the values for $t_1$ and $t_2$.

In embodiments, the photoreceptor surface should not move during the waiting time $t_1$ to insure that the same areas of the surface are exposed to the same pattern during the second exposure. This implies perfect registration and in optical copiers, optimized focus of the pattern being imaged. This assumption should be reasonable because otherwise color shifts would be apparent in current copier systems. In embodiments with a rotating drum photoreceptor, perfect registration can be accomplished with an exposure system that writes line segments perpendicular to the drum axis, such as an LED bar. Since the line segments are written perpendicularly, the exposure system is stationary and errors due to mechanical misregistration are avoided. Alternatively, a second LED image bar aligned with the first LED bar in an alignment fixture and secured to a common mounting block can also be employed. As a result, the optical portion of the exposure system is the limiting factor for resolution.

Several simplifications and assumptions were made in quantifying the LCM. First, it was assumed that the photoreceptor thickness was sufficiently thin that the spatial frequency dependence of the electrostatic potential could be ignored. The surface potential for sinusoidal charge distribution $\sigma_o+\sigma_k\cdot\cos(k\cdot y)$ for a grounded counter electrode placed far away from the photoreceptor surface ($d\rightarrow\infty$) is given by the equation:

$$V=\frac{\frac{s}{\varepsilon_s}\sigma_0}{1+\frac{\varepsilon_d s}{\varepsilon_s d}}+\frac{\frac{1}{\varepsilon_d ks}th(kd)}{\frac{1}{\varepsilon_s}+\frac{1}{\varepsilon_d}\frac{th(kd)}{th(ks)}}\frac{s}{\varepsilon_s}\cdot\sigma_k\cos(ky)\xrightarrow{t\rightarrow\infty}$$

$$V_o+\frac{\frac{1}{\varepsilon_d ks}}{\frac{1}{\varepsilon_s}+\frac{1}{\varepsilon_d\cdot th(ks)}}\cdot V_k\cos(ky)$$

Sufficiently thin photoreceptor here means that the product $k\cdot s$ is small enough for the spatial frequency $k=2\pi/L$ to neglect the term in front of $V_k\cdot\cos(k\cdot y)$ in first order to simplify the solution of the charge conservation equation:

$$\frac{\partial j}{\partial x}+\frac{\partial\sigma}{\partial t}=0$$

where j is the surface current density. As a result applying Ohms's law $j=E/R_s$ one obtains the telegraph equation:

$$\frac{1}{R_s}\cdot\frac{\partial^2 V}{\partial x^2}-\frac{\varepsilon}{s}\frac{\partial V}{\partial t}=0$$

Instead of expanding this model to more dimensions to include the dark decay one can account for it by adding a current sink term. Experimentally for low and moderate fields (<25V/μm) a power law in time and for higher fields a linear term in potential are good approximations. Hence, $$\frac{1}{R_s}\cdot\frac{\partial^2 V}{\partial x^2}-\frac{\varepsilon}{s}\frac{\partial V}{\partial t}-\begin{cases}A\cdot t^P\\ \frac{V}{s\cdot\rho}\end{cases}=0$$

The example in FIG. 2 cancels the top term in the case of low to moderate fields. In the above equation, $R_s$ has the same units as surface resistivity and ρ the same units as bulk resistivity. $R_s$ is driving the LCM through the time constant τ and is at moderate fields $$\tau=\frac{\varepsilon\cdot R_s}{s}\frac{1}{k^2}$$

t which the potential difference decays. Note the strong spatial frequency dependence.

NUMERICAL EXAMPLE

Figure 3:
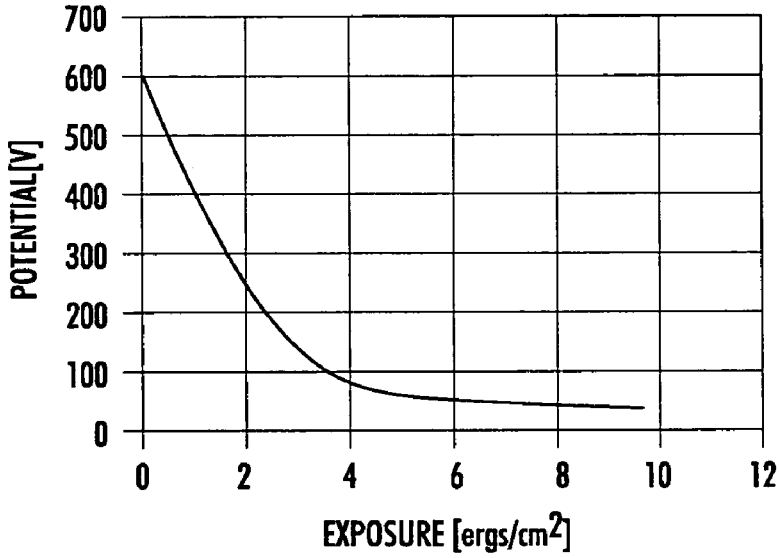
FIG. 3 is a graph showing a standard photo-induced discharge curve (PIDC).
Figure 4:
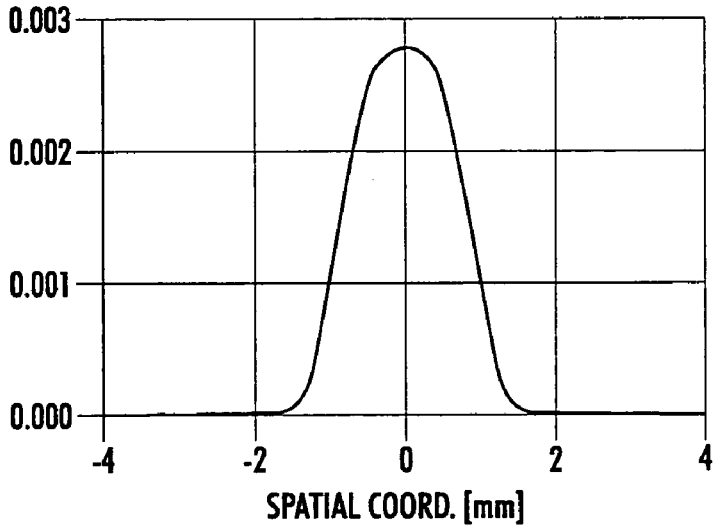
FIG. 4 is a graph showing the experimental point spread or response function of a standard low-resolution electrostatic voltmeter.

A Ronchi ruling (exact rectangular line pattern) of about 250 lpi was used. A worst-case scenario was used where the optics were so badly focused that only the first harmonic survived. A PIDC having the following parameters was used: $S=200\ V\cdot cm^2/ergs$; $V_c=140V$; and $V_R=20V$. Incomplete discharge of 3 ergs/cm$^2$ was also assumed. FIG. 3 shows the PIDC used in the numerical example. A standard low-resolution ESV was used to measure the surface potential. The experimental point spread of the ESV is shown in FIG. 4. Two different photoreceptors were used. The first photoreceptor was known to have no LCM and the second photoreceptor was known to have LCM.

Figure 5:
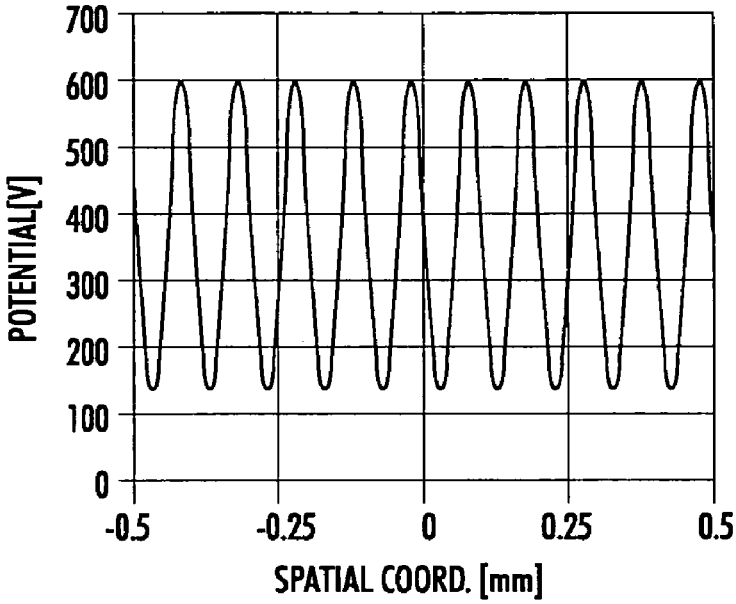
FIG. 5 shows the latent image for a photoreceptor without LCM after a first exposure to an aerial image of a poorly-focused rectangular line pattern.
Figure 6:
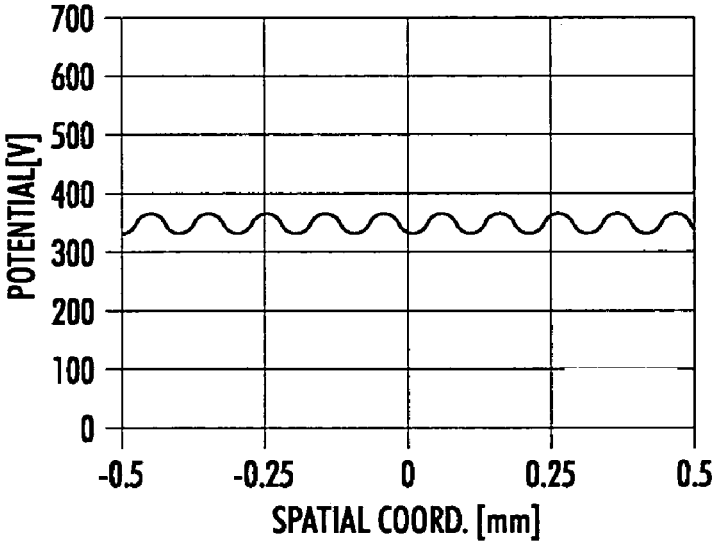
FIG. 6 shows the latent image for a photoreceptor with LCM after a first exposure to a poorly-focused rectangular line pattern.

The two photoreceptors were charged to a uniform potential of 600V at an exposure of 10 ergs/cm$^2$ and then exposed through the Ronchi ruling. After a period of time, corresponding to the 'Pause' row in FIG. 1, the surface potential of the two photoreceptors was measured with the ESV. FIG. 5 shows the result for the photoreceptor without LCM and FIG. 6 shows the result for the photoreceptor with LCM. A comparison of the two figures shows the peaks and troughs as much more clearly defined in FIG. 5, whereas they are very small in FIG. 6, reflecting the migration of charge from the peaks into the troughs.

Figure 7:
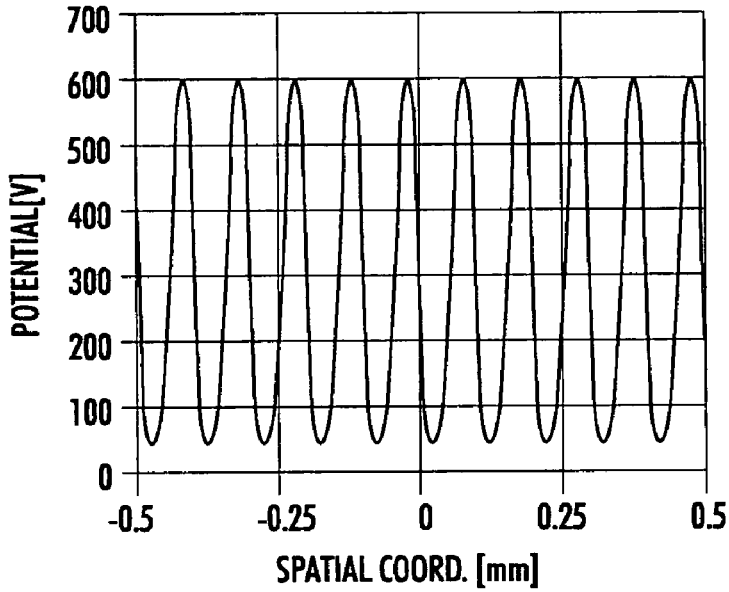
FIG. 7 shows the latent image for a photoreceptor without LCM after a second exposure to a poorly-focused rectangular line pattern.
Figure 8:
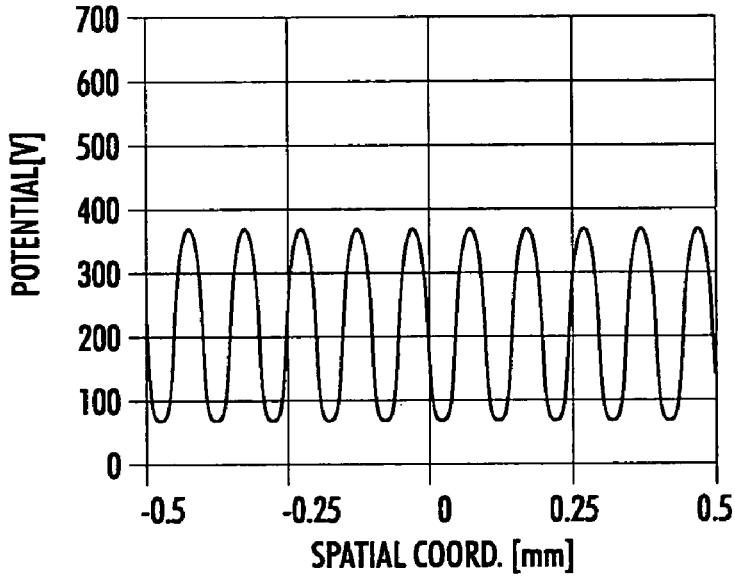
FIG. 8 shows the latent image for a photoreceptor with LCM after a second exposure to a poorly-focused rectangular line pattern.

After a second exposure, the surface potential of both photoreceptors was measured again. FIG. 7 shows the result for the photoreceptor without LCM and FIG. 8 shows the result for the photoreceptor with LCM. The scale along the y-axis should be noted; the magnitude of the peaks in FIG. 8 are roughly equivalent to the values of the peaks in FIG. 6 and roughly half those of the peaks in FIG. 7, as expected.

Figure 9:
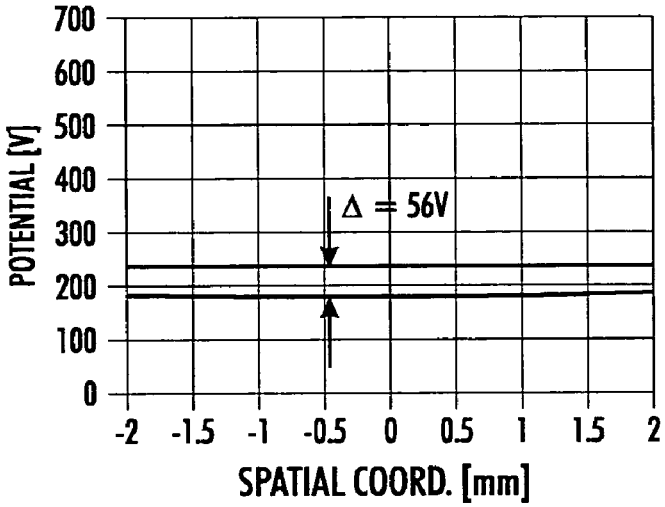
FIG. 9 shows the difference between the ESV probe responses of the resulting latent images of FIGS. 7 and 8.

FIG. 9 shows the difference between the average potentials of the latent images of FIGS. 7 and 8. The black line corresponds to the ESV probe response of the potential of the photoreceptor without LCM and the red line corresponds to the ESV probe response of the potential of the photoreceptor with LCM. There is a difference of 56V.

Figure 10:
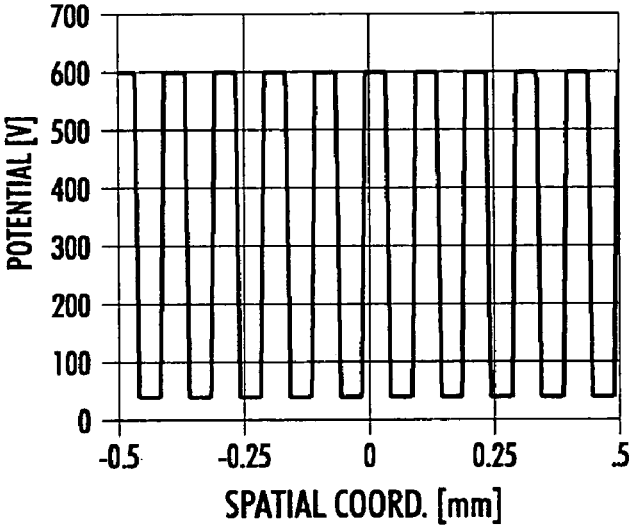
FIG. 10 shows the latent image for a photoreceptor without LCM after a first exposure to a rectangular line pattern.
Figure 11:
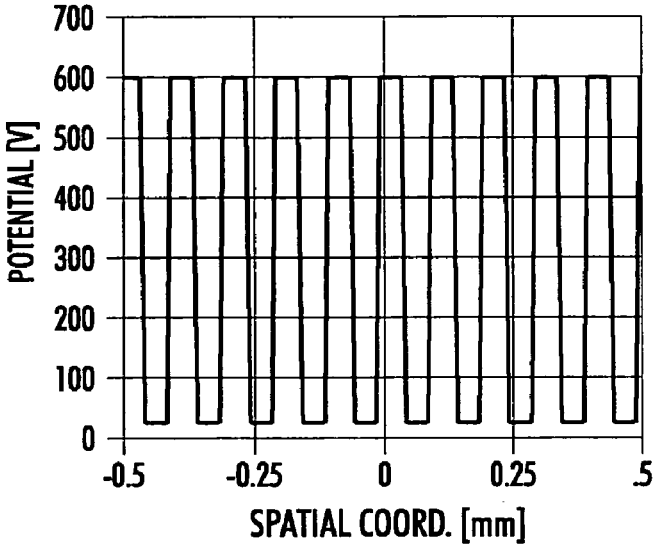
FIG. 11 shows the latent image for a photoreceptor without LCM after a second exposure to a rectangular line pattern.

While the numerical example was a worst-case scenario, FIGS. 10 and 11 show an example where the optics are properly aligned. Here, the photoreceptor was charged to a potential of 600V at 8 ergs/cm$^2$, then exposed to the same Ronchi ruling. FIG. 10 shows the surface potential for the photoreceptor without LCM after the first exposure and pause; FIG. 11 shows the surface potential for the photoreceptor with LCM after the second exposure.

Figure 12:
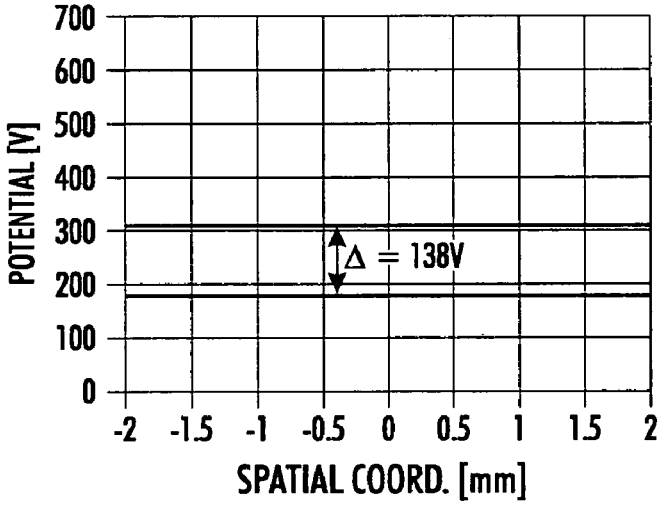
FIG. 12 shows the difference between the ESV probe responses to the resulting latent images of FIGS. 8 and 11.

FIG. 12 shows the difference between the average potentials of the latent images of FIGS. 11 and 8. The black line corresponds to the ESV probe response of the potential of the photoreceptor without LCM and the red line corresponds to the ESV probe response of the potential of the photoreceptor with LCM. Here, there is a difference of 138V, more than double that of the numerical example.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A method for measuring lateral charge migration upon the surface of a photoreceptor, comprising:

providing an area of a photoreceptor which is charged to a uniform value over said area;

exposing said area a first time to a light pattern;

pausing for a first period of time;

exposing said area a second time to said light pattern;

pausing for a second period of time; and, measuring the average potential over said area.

2. The method of claim 1, wherein said step of exposing said area a first time is performed by exposing said area to an light pattern selected from the group consisting of any type of light intensity distribution in the exposure.

3. The method of claim 1, further comprising:

storing said average potential.

4. The method of claim 1, wherein said step of pausing for a first period of time is performed by pausing from any arbitrary time and wherein said step of pausing for a second period of time is performed by pausing from any arbitrary time.

5. A method for measuring lateral charge migration upon the surface of a photoreceptor, comprising:

providing an area of a photoreceptor which is charged to a uniform value over said area;

creating a reference potential comprising:

exposing said area a first time to an light pattern;

pausing for a first period of time;

exposing said area a second time to said light pattern;

pausing for a second period of time; and measuring the average potential over said area to create a reference potential;

recharging said area to said uniform value; and creating a test potential comprising:

exposing said area a third time to said light pattern;

pausing for a third period of time;

exposing said area a fourth time to said light pattern;

pausing for a fourth period of time; and measuring the average potential over said area to create a test potential; and calculating the difference between said reference potential and said test potential;

wherein the sum of said first period of time and said second period of time is equal to the sum of said third period of time and said fourth period of time;

wherein said first period of time is shorter than said third period of time; and wherein said second period of time is longer than said fourth period of time.

* * * * *